US008052462B2

(12) United States Patent
King, Jr. et al.

(10) Patent No.: US 8,052,462 B2
(45) Date of Patent: Nov. 8, 2011

(54) WATERPROOF HEAT CYCLEABLE PUSH-IN WIRE CONNECTOR

(75) Inventors: L. Herbert King, Jr., Jupiter, FL (US); William Hiner, O'Fallon, MO (US)

(73) Assignee: The Patent Store LLC, O'Fallon, MO (US)

( * ) Notice: Subject to any disclaimer, the term of this patent is extended or adjusted under 35 U.S.C. 154(b) by 44 days.

(21) Appl. No.: 12/653,558

(22) Filed: Dec. 16, 2009

(65) Prior Publication Data

US 2011/0143565 A1 Jun. 16, 2011

(51) Int. Cl.
*H01R 4/24* (2006.01)

(52) U.S. Cl. ..... 439/441

(58) Field of Classification Search ..... 439/441, 439/440, 436–439, 935, 309, 857
See application file for complete search history.

(56) References Cited

U.S. PATENT DOCUMENTS

| | | | | |
|---|---|---|---|---|
| 3,941,444 | A * | 3/1976 | Bruni et al. | 439/587 |
| 6,257,919 | B1 * | 7/2001 | Cutler et al. | 439/441 |
| 6,746,286 | B2 | 6/2004 | Blaha | |
| 7,255,592 | B1 | 8/2007 | Tseng | |
| 7,833,038 | B1 * | 11/2010 | King et al. | 439/276 |
| 2009/0017660 | A1 * | 1/2009 | Braganza et al. | 439/276 |

* cited by examiner

*Primary Examiner* — Chandrika Prasad
(74) *Attorney, Agent, or Firm* — Jacobson and Johnson LLC

(57) ABSTRACT

A push-in wire connector having at least two resilient members for generating a wire contacting force with one of the two resilient members exerting a greater contact force than the other to permit forming electrical connections to different size or types of wires by axially inserting wires into a sealant and into electrical contact engagement in the push-in wire connector to form a waterproof electrical connection in the presence of the sealant.

20 Claims, 3 Drawing Sheets

WATERPROOF HEAT CYCLEABLE PUSH-IN WIRE CONNECTOR

FIELD OF THE INVENTION

This invention relates generally to push-in wire connectors and, more specifically, to a waterproof universal push-in wire connector for forming an electrical connection with different sizes or types of wires.

CROSS REFERENCE TO RELATED APPLICATIONS

None

STATEMENT REGARDING FEDERALLY SPONSORED RESEARCH OR DEVELOPMENT

None

REFERENCE TO A MICROFICHE APPENDIX

None

BACKGROUND OF THE INVENTION

Numerous types of aggressive electrical wire connectors for forming bared ends of electrical wires into a waterproof electrical connection are known in the art. One type of aggressive electrical connector relies on inserting the wires into a sealant located between a terminal block and a terminal screw and then squeezing the bared ends of the wire by rotating the terminal screw. The more the terminal screw is tightening the greater the squeezing and hence the better the electrical connection between the bared wire end and the terminal screw, however, one must take care shearing the terminal screw by over torquing the screw.

Another type of aggressive electrical wire connector is a twist-on wire connector that can be used to form a waterproof electrical connection through rotation of the electrical wires in a spiral shape housing containing a sealant. In the twist-on wire connector as well as in the terminal connector, in general, the more aggressive the rotation the greater the compression of the wire ends and hence an enhanced electrical connection between the electrical wires.

Another type of aggressive electrical wire connector, which is used with unstripped wires, is a cutting connector that uses two blades that slice through the insulation layer of the electrical wire and also cut into the sides of the wire, which is located in a waterproof sealant. In each of these prior connectors the electrical connection can be formed in the presence of a waterproof agent through use of a force sufficient to negate the presence of a waterproofing and electrically insulating agent located on and between the electrical wires.

Another type of electrical connector, which lacks aggressiveness, is a push-in wire connector. A push-in wire connector is a less aggressive wire connector since the force on the wire by the connector is generated by a fixed cantilevered mounted electrical conductor that flexes to allow insertion of an electrical wire between the conductor and a bus strip. An example of a push-in wire connector that shows one resilient spring is shown in U.S. Pat. No. 6,746,286 and an example of a push-in wire connector that includes two resilient springs for engaging an electrical wire to form an electrical connection as a wire is inserted in the connector is shown in U.S. Pat. No. 7,255,592.

The clamping force holding the wire in electrical contact with bus strip and the electrical conductor of the push-in wire connector are determined by the resilient force of the resilient springs and can not be increased by more aggressive action such as in twist-on wire connectors since the axial force applied to flex the resilient spring conductors in a push-in wire connector is limited by the stiffness of the wire. That is, to generate a clamping force on the electrical wire in a push-in wire connector the wire must be inserted in an axial direction, which is at 90 degrees to the direction of force generated by the resilient conductor. Thus, the resilient electrical conductor in a push-in wire connector must flex in response to one axially inserting a wire therein. The wire clamping force in the push-in wire connector is limited because the axial resistance of the resilient conductor must not be so large so as to bend the electrical wire during the insertion process. Consequently, clamping forces generated by push-in wire connectors lack the inherent aggressive nature of other connectors that can force sealant away from contact areas between conductors.

Although the push-in wire connectors lack the aggressiveness of other electrical wire connectors the push-in wire connector are simple to use since an electrical connection can be made in one continuous motion. That is, one axially inserts an electrical wire into a chamber in the push-in wire connector until the wire forms electrical engagement with a resilient conductor that automatically flexes to form pressure engagement with the electrical wire. Typically, in the push-in wire connector cylindrical elements of a cylindrical wire engage both a bus strip and a resilient conductor as they sandwich the electrical wire between a straight edge on the resilient wire conductor and the bus strip. However, the lack of an ability to increase the force on the contact regions between the edge, the bus strip and the wire limit the ability to enhance the electrical connection in a push-in wire through use of additional force and thus impair the electrical connection to withstand heat cycling.

If a waterproof heat cycleable electrical connection is required in a push-in wire connector the conventional methods of waterproofing are to either place an elastic bushing around the wire before the wire is inserted into the push-in wire connector to form a waterproof seal around the electrical wire or to inject a sealant in the push-in wire connector after the wire has been inserted into engagement with the electrical conductor and bus strip therein. In still another method of waterproofing push-in wire connectors the entire push-in wire connectors with the electrical wires therein is inserted into a housing containing a sealant which allows one to encapsulate the entire push-in wire connector and thereby waterproof the wire connections therein.

One of the difficulties in forming waterproof electrical connections is also ensuring that the electrical connection formed in the presence of the sealant is capable of withstanding the heat cycling that may occur during field use of the push-in wire connector.

SUMMARY OF THE INVENTION

A waterproof push-in wire connector containing at least two resilient members located in wire alignment with each other with the spring force of one of the resilient spring members greater than the other to enable the at least two resilient spring members to form a heat cycleable electrical connection with a range of different types and size wires.

DESCRIPTION OF THE PREFERRED EMBODIMENT

Figure 1:
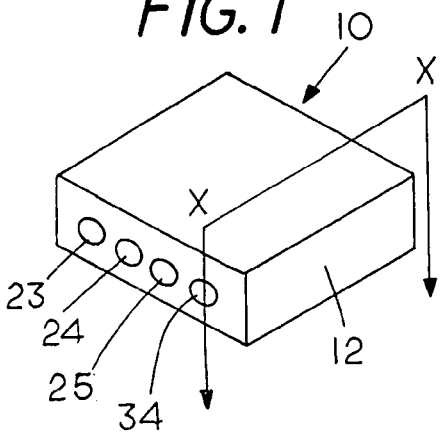
FIG. 1 shows a perspective view of a push-in wire connector.

FIG. 1 shows a perspective view of a push-in wire connector 10 having a housing 12 containing a wire displaceable sealant therein. Housing 12 includes a first wire socket 23, a second wire socket 24, a third wire socket 25 and a fourth wire socket 34 each having an axial wire inlet passage. In joining ends of wires into an electrical connection in the waterproof push-in wire connector 10 a first bared wire end may be axially inserted into socket 24 and a further bared wire end may be axially inserted into socket 34 with both wire ends entering into engagement with a common bus strip therein to form an electrical connection between the wires. If desired other wires may also be inserted in identical ports 23 or 25.

The push-in wire connector 10 allows one to quickly form a waterproof electrical connection for a range of different size and types of wires in a one step process by axially inserting a wire into electrical contact with at least one resilient member in the presence of a wire displaceable sealant. The electrical connection is obtained without requiring additional steps such as either rotating the wires or squeezing the wires or forcing jaws or clamps onto the electrical wire. In the example of the invention shown herein, a wire displaceable sealant, which is located in a chamber in the connector 10 waterproofs the resilient members located in the chamber. As a wire is axially inserted into the axial passage the wire flexes the resilient members therein in the presence of the sealant to form a waterproof electrical connection thereto that can withstand heat cycling of the electrical connection that may occur during field use of the connector.

Figure 2:
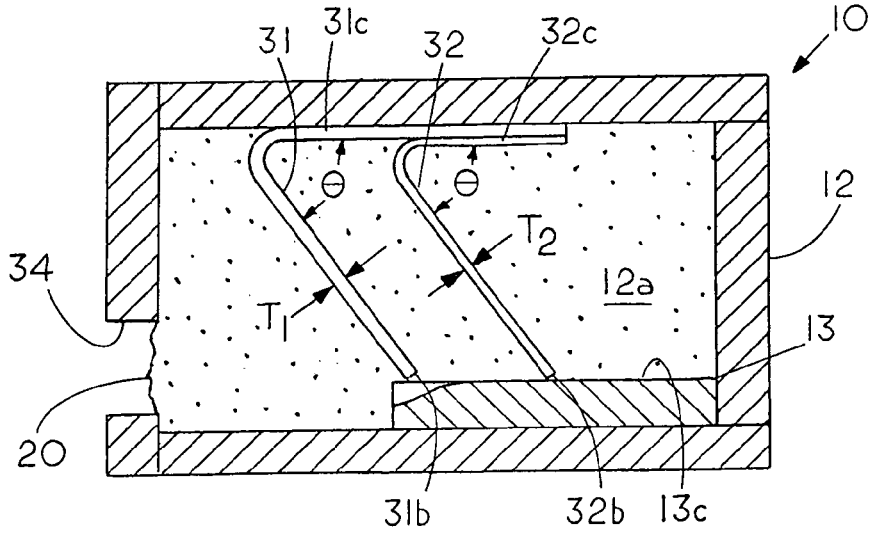
FIG. 2 shows a cross sectional view of a push-in wire connector of FIG. 1 taken along plane x-x of FIG. 1.

FIG. 2 shows a cross sectional view of push-in wire connector 10 taken along plane x-x of FIG. 1. Push-in wire connector 10 comprises a housing 12, which for example may be made from an electrical insulating material such as a polymer plastic, with a chamber 12*a* therein. Located in the chamber 12*a* and held in position by housing 12 is an electrical conductor comprising an elongated bus strip 13. Bus strip 13 is an electrical conductor, and may for example be a metal such as copper or copper plated member although other materials are within the scope of the invention. Positioned proximate to the bus strip 13 is a first V shaped resilient member comprising a resilient electrical conductor 31 having a wire contact region comprising an edge 31*b* for scrapingly engaging an outer surface of an electrical wire and a second V shaped resilient member comprising a resilient electrical conductor 32 having a wire contact region comprising an edge 32*b* for scrapingly engaging an outer surface of an electrical wire to bring the resilient member into an electrical connection in the presence of the sealant. In the example shown each of resilient members 31 and 32 are formed at an acute angle Θ so that the wire engaging edge 31*b* and wire engaging edge 32*b* of each of the resilient members exerts a downward pressure on a wire located on the bus strip 13 with sufficient force so as to maintain an electrical connection between a wire therein and the resilient member in the presence of the sealant. While resilient members 31 and 32 are shown as electrical conductors the members 31 and 32 may be non-electrical conductors i.e. electrical insulating members since the bus strip 13 can be used to form an electrical connection with the wires therein through the pressure of the wires against the bus strip 13 by the resilient members. In still other examples the bus strip 13 may be replaced with a non-electrical conductor strip and the electrical connection may then be formed with the end of the resilient conductor due to the pressure between the end of resilient conductor and the non-electrical conductor strip. In still other examples the strip be an integral part of the housing.

In the example shown the first resilient conductor 31 exerts a larger downward force than the second resilient conductor 32 through the use of resilient conductors of the same material but of different thickness. That is the thicker $T_1$ resilient conductor 31 exerts a larger downward force than the thinner $T_2$ resilient conductor 32. While the generation of a larger downward force can be obtained by having resilient conductors of different thickness other ways of exerting greater force in one of the resilient connectors over the other can for example be obtained by using different metals or using resilient conductors wherein the acute angles Θ formed by the resilient conductors are unequal. Similarly, the use of legs of unequal lengths in the resilient conductors can produce a resilient conductors that generate different forces since a greater force can be exerted by the resilient conductor with the shorter leg.

When in the unengaged condition, as shown in FIG. 2, the resilient conductors 31 and 32 are positioned so as to extend downward so that when a wire is axially inserted into port 34 the wire first contacts resilient conductor 31 and then contacts resilient conductor 32 in the presence of the wire displaceable sealant 20. The wire displaceable sealant not only waterproofs the resilient conductors 31 and 32 as well a bus strip 13 but can act as a lubricant to reduce the frictional resistance to axial insertion of a wire therein. During insertion the axial insertion of a wire into the axial passage 34 the resilient conductor 31 and resilient conductor 32 flex and then engage the wire with a compressive force to form a waterproof heat cycleable electrical connection between the wire and the bus strip 13.

As can be seen in FIG. 2 the wire displaceable sealant 20 is located in chamber 12*a* and inlet 34 and covers the top surface 13*c* of bus strip 13 as well as the end of electrical conductors 31 and 32 to waterproof the bus strip 13 and the first resilient conductor 31 and the second resilient conductor 32. The wire displaceable sealant 20 located in the chamber 12*a* waterproofs the first resilient conductor 31 and the second resilient conductor 32 in the chamber 12*a* since the sealant surrounds the normally exposed portions of the resilient conductors. The waterproof sealant 20 surrounding the resilient conductor 31 and 32 is deformable and pierceable and viscous to allow the sealant to be maintained in contact with the conductors during flexing of the resilient conductors as a wire is axially inserted into the axial passage 34 and into engagement with the resilient conductors. That is, when a wire is axially inserted into the push-in connector 10 the resilient conductor 31 can flex and move in the presence of the wire displaceable sealant 20 while maintaining a waterproof covering as an electrical connection is formed with bus strip 13*c*. Similarly, the resilient conductor 32 can flex and move in the presence of the wire displaceable sealant 20 while maintaining a waterproof covering as an electrical connection is formed with bus strip 13*c* and a second wire.

Although the resilient conductors 31 and 32 can generate limited compressive force on a wire one can still form a low resilient electrical connection between the wire and the resilient conductor 31 and 32 in the presence of an electrically insulating sealant. However, one of the difficult is that the range of sizes and types of wires that one can form an electrical connection are limited by the resilient member. Thus one may require multiple push-in wire connectors in order to connect different size and types of wires in an electrical connection that can withstand heat cycling conditions that may occur in field conditions. Heat cycling can occur as the temperature of the wire at an electrical connection increases due to environmental conditions or to current flow through the electrical connection. In either case the resistance of the electrical connection between the resilient conductor or bus strip and the wire must remain sufficiently low or the electrical connection may fail.

While an electrical connection can be formed through axial insertion of a wire into the resilient conductors the electrical connection formed may not be able to withstand heat cycling for all size and types of wires and still be able to provide for axial insertion of a wire into the push-in wire connector as the axial deflecting force generated by some wires is insufficient. For example, wires of larger diameter have sufficient axial rigidity so that the wire can, without bending, exert a greater deflecting force on the resilient conductor than a smaller wire. Thus, a larger wire allows one to use a resilient connector that exerts a large wire engagement force on the wire than a smaller wire. Generally, solid wires of the same size can better maintain their axial integrity without bending better than stranded wires of the same size. However, to obtain an electrical connection that can withstand field use the minimum amount of compressive wire engagement force required by the resilient conductors may not be the same for all size and types of wires.

In order to provide for a push-in wire connector where the electrical connection formed therein can accommodate different size and types of wires and yet withstand field use the push-in connector described herein uses two resilient members each generating separate wire engagement forces. A common test for determine if a wire connector can withstand field conditions is a heat cycling test which is described in UL 486C report titled Splicing Wire Connectors and is hereby incorporated by reference.

FIG. 2 shows a set of resiliently displaceable members or resilient conductors 31 and 32. In the embodiment shown the resilient conductors each comprise a V-shaped leaf spring or the like which is cantilevered mounted within housing 12. Conductor 31 has one leg 31*c* held in face-to-face contact with housing 12 through fastening members or through various methods including but not limited to such methods as spot welding or such fasteners as mechanical fasteners. The other leg 31*a* extends downward with edge 31*b* in engagement with a bus strip 13. Similarly, electrical conductor 32 also comprises a cantileverly mounted resiliently displaceable member, such as a V-shaped leaf spring or the like which has one leg 32*c* held in face to face contact with leg 31*c* and housing 12 through fastening members or through various methods including but not limited to such methods as spot welding or such fasteners as mechanical fasteners. The other leg 32*a* of resilient conductor 32 extends downward with edge 32*b* in engagement with a bus strip 13. In the example shown the resilient conductors 31 and 32 each form the same acute angle Θ between their respective legs when in the relaxed or unconnected state although the wire engagement force exerted by each of the resilient conductors is different from each other although the angles may also be unequal.

As can be seen in FIG. 2 the wire displaceable sealant 20 encompasses or protects the electrical conducting components of bus strip 13 and the angled end 31*b* of conductor 31 and the angled end 32*b* of conductor 32 from external moisture. While 34 socket and the resilient conductors located therein have been shown and described the sockets 23, 24 and 25, which are identical are not described herein.

Figure 5:
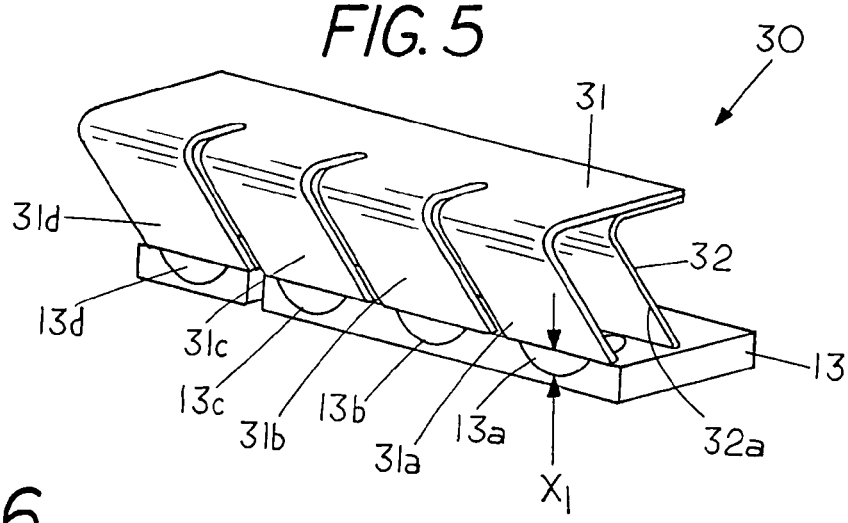
FIG. 5 shows a perspective view of a double leg resilient member and bus strip useable in the push-in wire connector of FIG. 2.
Figure 6:
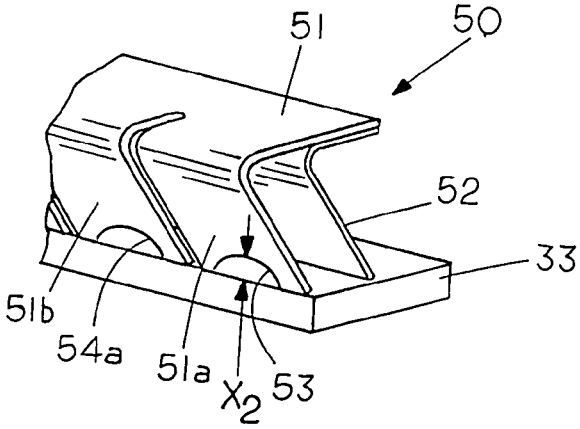
FIG. 6 shows a further embodiment of a double leg resilient member and bus strip usable in the push-in wire connector of FIG. 2.

In the example of FIG. 1 behind each socket of the push-in wire connector 10 is a pair of resilient members and a common bus strip that extends from one socket to the other socket so that two or more wires can be electrically joined in the presence of a wire displaceable sealant by axially inserting a bared end of electrical wires into two or more of the wire sockets in housing 12. FIG. 5 and FIG. 6 illustrate different types of ganged resilient members or resilient conductors and bus strips that may be used in the push-in wire connector 10.

Figure 3:
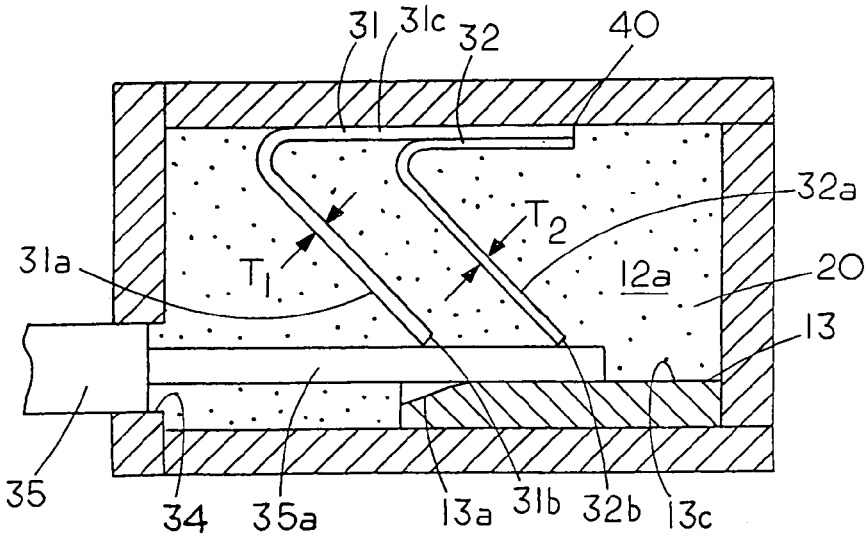
FIG. 3 shows a cross sectional view of the push-in wire connector of FIG. 2 with the bared end of an electrical wire contacting a bus strip and an electrical conductor.
Figure 4:
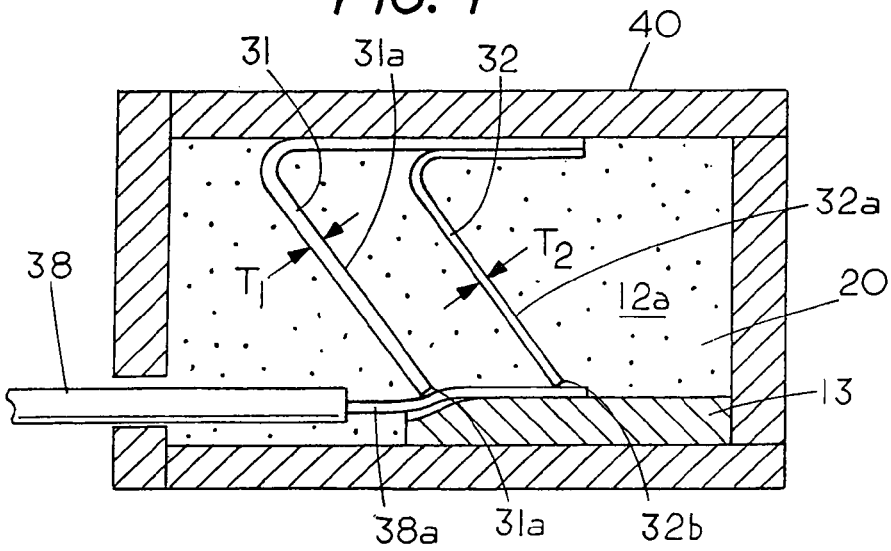
FIG. 4 shows a cross sectional view of the push-in wire connector of FIG. 2 with the bared end of a different electrical wire contacting a bus strip and an electrical conductor.

FIG. 3 and FIG. 4 illustrate the step of forming an electrical connection in a push-in wire connector having ganged resilient members in the presence of a waterproof sealant where different size wires are inserted into a wire port in order to reveal how one set of resilient conductors can form an electrical connection that can withstand heat cycling even though different size wires are joined to the bus strip. FIG. 3 shows the push-in wire connector 10 with a large diameter electrical wire 35 with a bared or insulation free end 35*a* penetrating the sealant 20. In this portion of the step of forming of the waterproof electrical connection the bared end 35*a* of wire 35 is axially inserted into socket 24 and into the sealant 20 in the push-in wire connector 10. The sealant 20, which is wire displaceable can be penetrated by the axial stiffness of the wire 35. The resistance to penetration of sealant 20 by wire 35 is insufficient to cause bending of the wire 35 as the wire end 35*a* is inserted into the wire displaceable sealant 20.

In the example shown in FIG. 3 each of the resilient conductors 31 and 32 exert a different wire engagement force but nevertheless each exert sufficient compressive force to form an electrical contact with wire 35*a* to thereby forming an electrical connection that can be subjected to heat cycling without loosing the integrity of the electrical connection. Generally, for a larger diameter wire the minimum wire engaging force generated by the resilient conductors 31 and 32 may have to be greater than with a smaller diameter wire in order to ensure that the electrical connection formed therein can withstand a heat cycle. However, if the same resilient conductors 31 and 32 are used for connecting smaller diameter wires of less stiffness or axial rigidity the smaller diameter wires may bend when they encounter the flexing resistance of the electrical conductors. For example, the first resilient connector 31 may be able to flex and have a sufficiently high spring constant that the compressive wire engagement force generated by the resilient conductor is sufficient to ensure the formation of an electrical connection that can withstand field conditions. Unfortunately, a smaller size wire may lack sufficient rigidity to flex the resilient conductor 31 so that one can generate the necessary compressive wire engagement force.

FIG. 4 illustrates the operation of the push-in wire connector 10 where the first resilient member 31 generates a greater axial resistance to deflection then the second resilient member 32. In this example wire 38*a* lacks sufficient axial rigidity to flex resilient conductor 31 and pass thereunder in the manner that wire 35*a* flexes resilient conductor 31 as illustrated in FIG. 3. However, wire 38*a* does have sufficient axial rigidity to flex resilient conductor 32 and form an electrical connection that can withstand field conditions. As shown in FIG. 4 the wire 38*a* is directed partially under first resilient conductor 31 by a bypass port which has the effect of reducing the axial resistance to wire 38*a* since the resilient conductor bends less and hence less axial force is required to pass thereunder. A benefit of using heavier or thicker springs that can generate greater compressive force is that the larger compressive force makes is more difficult to accidentally pull a wire or wires from the wire connector.

A reference to FIG. 5 illustrates the bypass port 13*a* under first resilient conductor 31 may have a dimension $X_1$ between the edge 31*a* and the bus strip 13 to permit the passage of a wire 38 having lesser axial rigidity. A reference to FIG. 6 illustrates that the bypass port may be located in the resilient member 51*a* rather than in the bus strip 13 and have a dimension $X_2$ to reduce the resistance to a wire passing thereunder.

FIG. 4 illustrates that after wire 38*a* partially engages the first resilient conductor 31 to reduce the axial resistance of resilient member 31 the wire 38*a* is then directed toward the second resilient member 32, which has lesser flexing resistance than the first resilient conductor 31. Although resilient member 32 has less axial resistance than resilient member 31 the resilient members 32 exerts sufficient downward compressive force to form an electrical connection with bus strip 13 that can withstand field conditions. In this example the smaller wire 38*a*, which lacks sufficient rigidity to flex first resilient conductor 31*a*, is allowed to partially bypass the first resilient conductor 31. Subsequently, wire 38*a* can then be brought into engagement with the second resilient conductor 32 through normal flexing of the resilient conductor 32 as the wire 38*a* passes thereunder. Thus, by using a bypass port 13*a* to lessen the axial resistance to insertion of the wire into the connector 10 one can axially extend wire 38*a* past the resilient conductor 31 which normally would cause wire 38*a* to bend. Consequently, once past resilient member 31 can emerge with sufficient rigidity to deflect resilient conductor 32 which can generate a wire engagement force sufficient to form an electrical connection that can withstand field conditions. Thus, even if a connector 10 contains a pair of resilient conductors where the flexing force of one of the connectors may bend the wire the use of the bypass port 13*a* to reduce the axial resistance to a wire one can allow a wire which normally lacks sufficiently axial rigidity to form an electrical connection. Since the height $X_1$ of bypass port 13*a* or $X_2$ of bypass port 53 is less than the diameter of the largest wire the larger wire can make full engagement with the with bus strip 13 through the downward compressive force generated by the resilient members 31 and 32. It will be apparent that with the example shown in FIGS. 2, 3 and 4 one is not limited to use of the connector 10 with only one size wire as one can form electrical connections with a range of different types and sizes of wires where the axial rigidity of the wires are unequal.

Figure 7:
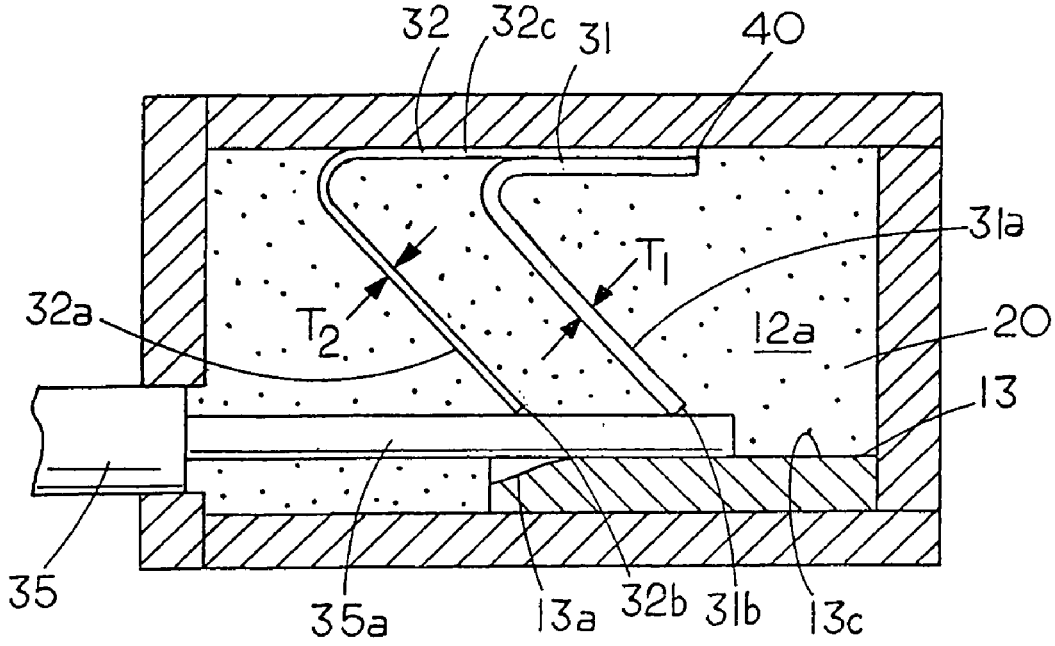
FIG. 7 shows an embodiment of a waterproof pushing wire connector with the second resilient member for generating a large wire engaging force than the first resilient member.

FIG. 7 shows an example of the waterproof push in wire connector where the resilient member 31 and 32 have been reversed. That is the resilient member 31 which generates the larger wire engaging force is positioned after the first resilient member 32 which generates the lesser wire engaging force. In this example the larger diameter wire 35*a* engages both the resilient member 31 and 32 as illustrated in FIG. 7. As seen in FIG. 7 the axial rigidity of the wire 35 is sufficient to flex either resilient member 31 or resilient member 32 to bring the bared electrical wire 35*a* into electrical engagement with the bus strip 13.

Figure 8:
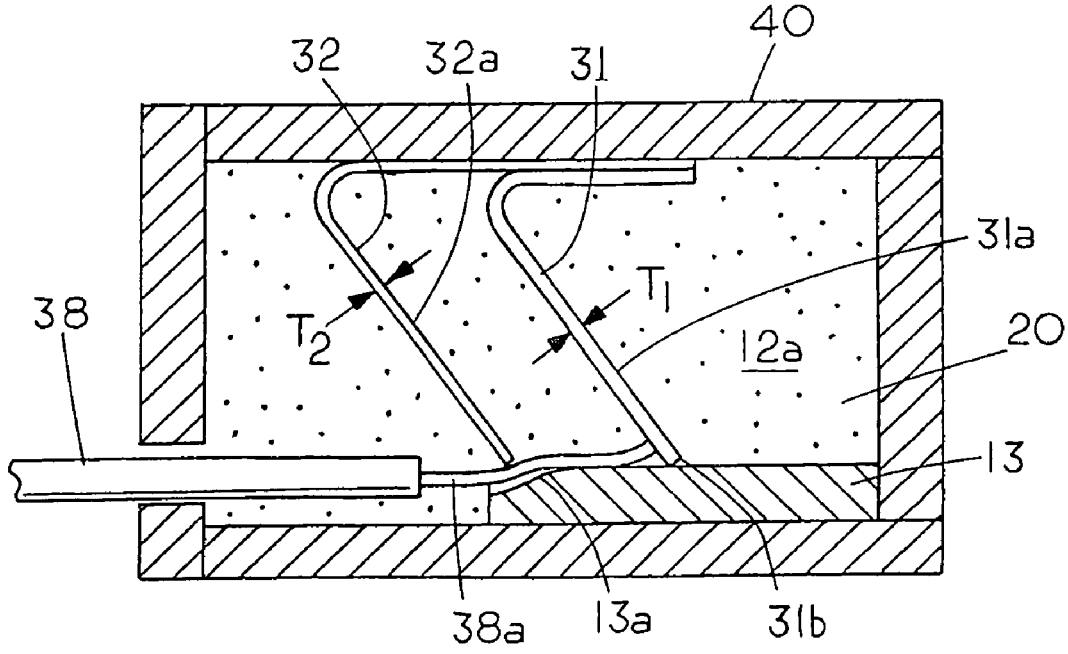
FIG. 8 shows the embodiment of FIG. 7 with a smaller diameter wire in engagement with the first resilient member.

FIG. 8 shows the embodiment of FIG. 7 in engagement with a smaller wire 38*a* which lacks the axial rigidity of wire 35. In this example the smaller wire 38*a* can, without bending, be forced under resilient member 32 to form the electrical connection thereto. That is, the axial rigidity of wire 38*a* is sufficiently rigid to allow wire 38*a* to be directed thereunder without bending. Although a bypass port is shown a bypass port may be omitted since the rigidity of the wire is sufficient to force the wire into electrical engagement with the resilient member 32. If desired a guide may be placed in the bus strip 13 for the purpose of directing the wire toward the resilient member 32. Resilient member 32 is selected such that the downward force of the resilient member 32 generates a compressive force sufficient to form an electrical connection to bus strip 13. Thus, in this example the first resilient conductor 32 alone generates sufficient force to form wire 38*a* into electrical connection with bus strip 13 that can withstand field use. Continuing the application of axial force on the wire 38*a* causes wire 38*a* to encounters the resilient member 31 which generates a larger wire engagement force. Although the smaller wire 38*a* may not have sufficient axial rigidly to flex resilient member 31, and thus bend as shown in FIG. 8, the first connection formed by resilient member 32 generates sufficient wire engagement force to form an electrical connection that is able to withstand field conditions. Since the first resilient member generates sufficient force to form an electrical connection the contact between the second resilient member 31 may not be needed with wire 38*a*, however, and additional contact serves to enhance the electrical connection. Thus, in the waterproof push-in wire connector containing at least two resilient conductors located in wire alignment with each other with the spring force of one of the resilient spring conductors greater than the other it enables the at least two resilient spring connector to form a heat cycleable electrical connection with a range of different types and size wires solely through axial insertion of a wire into the push-in wire connector. The different spring force may be obtained though resilient conductors with different spring constants.

FIG. 5 shows an example of a ganged resilient connector 30 for use in push-in wire connector 10. Ganged connector 30 includes a first resilient connector 31 having four legs forming resilient conductors 31*a*, 31*b*, 31*c* and 31*d* which are positioned in front of second resilient connector 32 which also contains four resilient legs only one of which is visible in FIG. 5. As can be seen in FIG. 5 the edge 31*a* extends over a wire bypass port 13*a* located in bus strip 13. Similarly legs 31*b* extends over wire bypass port 13*b*, leg 31*c* extends over wire bypass port 13*c* and leg 31*d* extends over a wire bypass port 13*d*. Each of the legs of the resilient conductor 32 are identical. The height $X_1$ of the bypass ports are selected based on the diameter of the wire with the height $X_1$ being sufficient to allow bypass of wire of low axial rigidity while still having sufficient downward force to form an electrical connection to bus strip 13. If the resilient members are of unequal strength the first resilient member may be provide with the lesser resistance to axial force so that wires of unequal axial rigidity can be forced into an electrical connection.

FIG. 6 shows an example of a portion of another ganged resilient connector 50 wherein the ganged connector 50 includes a resilient connector 51 having two legs forming resilient conductors 51*a* and 51*b* which are positioned in front of resilient connector 52 which also contains two resilient legs only one of which is visible in FIG. 5. A bus strip 33 extends crosswise under the edges of the resilient conductors. In the example of FIG. 6 the bypass port 53 is located in the resilient conductor 51*a* rather than in the bus strip 33. In this example the curved bypass port 53 can only partially engage a wire, thereby lessening the axial resistance to extending a wire thereunder. The sealant 20, which is a waterproof sealant, is located in the push-in wire connector is characterized as a wire displaceable sealant. A wire displaceable sealant is sufficiently viscous so as to be normally retainable within the push-in wire connector during handling and storage of the push-in wire connector, yet yieldable and self healing to form a waterproof covering over a wire inserted therein. An examples of a type of sealant that may be used is a gel sealant although still other types of sealants such as viscous sealants including silicone sealants that may be used.

Gel sealants are commercially available in liquid form i.e. an uncured state and are often used for vibration damping. The gel sealant, when in the liquid or uncured state, is poured or placed into the chamber 12*a* in the push-in connector 10 containing a moveable part such as the resilient conductors 31 and 32. Since the sealant is in liquid form with low viscosity the sealant 20 flows around any movable parts, i.e. the resilient conductors 31 and 32 in the push-in wire connector. Once in position the sealant sets or cures to form a waterproof sealant that has sufficient cohesiveness so as to retain itself within the housing 12 in a ready to use condition. Once cured the gel sealant is capable of yielding in response to conductor movement and axial insertion of a wire into engagement with the conductor as well as self healing to form a waterproof covering over an electrical connection between an electrical wire inserted between the resilient conductor and the bus strip in the push-in wire connector.

If one wants to ensure that no pockets of air are retained in the chamber in the push-in wire connector the air can be removed from the chamber 12*a* before or after injecting the sealant in the chamber 12*a*. As an alternate method, an opening can be placed in the top portion of the housing 12 so that air is forced out as the sealant is injected therein. A further option is to have the ports extending upward as the sealant is directed into the chamber in the push-in wire connector so air can be forced out of the chamber as sealant is introduced therein. Sealants that can be placed in push-in wire connector, for example in assembled push-in wire connectors, can be either in liquid form or in viscous form. An example of a sealant in liquid form is a curable gel that is commercially available and generally comprises two parts that may either be mixed in the wire connector chamber or before placing the curable gel in the chamber of the push-in wire connector. The use of a curable gel in liquid form allows the gel, while still in the liquid state, to flow around and encapsulate or protect the wire contacting surfaces components in the chamber including the moving part or parts of the push-in wire connector.

Another method for introducing the sealant into an assembled or partially assembled push-in wire connector is to force or inject a viscous sealant into one of the ports until the sealant begins to appear in the other ports. It has been found that as the sealant 20 flows from one port to another port through the chamber the sealant flows around the wire connecting surfaces in the push-in wire connector. Also, in flowing from port to port air can be forced from the chamber 12*a* to provide a waterproof covering around the wire connecting surfaces that contact a wire inserted therein. The method of port injection can also be used if the push-in wire connector contains multiple ports, in such a case the sealant may be injected or forced into one or more of the ports.

While the introduction of sealant into the push-in wire connector may be stopped based on a visual indication, such as the sealant becoming visible in another port, it also may be stopped based on a known volume of sealant injected into the push-in wire connector. Also, the amount of sealant injected into the push-in wire connector may vary depending on the wiring application. For example, in some applications it may be desired that sealant not extend outside the ports of the push-in wire connector and in other applications one may want the sealant to extend outside the ports of the push-in wire connectors and onto the housing.

We claim:

1. A universal waterproof push-in wire connector for forming a heat cycleable electrical connection with wires having different axial rigidity comprising:

a housing having a chamber therein;

an axial wire passage in said housing;

a first resilient member having a first spring constant with the first resilient member located in the chamber, said first resilient member having a wire engaging edge;

a second resilient member having a second spring constant different from the first spring constant with the second resilient member located in the chamber, said second resilient member having a wire engaging edge with said second resilient member located in series with said first resilient member; and a wire displaceable sealant located in the chamber prior to axial insertion of a wire, said wire displaceable sealant encapsulating and waterproofing the first resilient member and the second resilient member so that axial insertion of the wire into the wire passage flexes at least one of the resilient member into an electrical connection in the presence of the wire displaceable sealant to thereby form a waterproof electrical connection that retains its electrical integrity under different field conditions.

2. The waterproof push-in wire connector of claim 1 wherein the first resilient member is an electrical conductor having a first thickness and the second resilient is an electrical conductor having a second thickness different from the first thickness.

3. The waterproof push-in wire connector of claim 1 wherein the first resilient member comprises a first metal and the second resilient member comprises a second metal different from the first metal.

4. The waterproof push-in wire connector of claim 1 wherein the first resilient member is located in front of and in axial alignment with the second resilient member so that a wire inserted into the push-in wire connector engages the first resilient member before engaging the second resilient member.

5. The waterproof push-in wire connector of claim 4 including a bypass port located below an edge of the first resilient member to allow a wire of a first gauge to at least partially bypass the first resilient member before engaging the second resilient member wherein the bypass port has a height less than the diameter of a wire inserted therein.

6. The waterproof push-in wire connector of claim 1 wherein the wire engaging edge on the first resilient member includes a bypass port therein and the wire displaceable sealant is a viscous electrical insulator.

7. The waterproof push-in wire connector of claim 1 wherein the heat cycleable electrical connection is defined by an electrical connection that can withstand an Underwriters Laboratories 486C heat cycle test.

8. The waterproof push-in wire connector of claim 1 wherein each of the resilient member comprise a cantilevered mounted resilient member each located at an acute angle to the axial wire passage.

9. The method of connecting at least two wires into a waterproof heat cycleable electrical connection comprising:

axially inserting a first wire into a first axial passage of a push-in wire connector having a chamber containing a sealant protecting a first resilient member and a second resilient member until the first wire is brought into electrical contact through pressure from the first resilient member and the second resilient member; and axially inserting a second wire into a second axial passage of the push-in wire connector having a further chamber containing the sealant protecting a third resilient member and a fourth resilient member until the second wire is brought into further electrical contact whereby an electrical connection formed by electrical contact through pressure from the third resilient member and the fourth resilient member retains its integrity when subjected to heating and cooling cycles.

10. The method of claim 9 wherein the at least two wires includes one wire having a larger gauge than the other.

11. The method of claim 9 wherein the at least two wires includes a solid wire and a stranded wire with each having different axial rigidity.

12. The method of claim 10 wherein the wire with the larger gauge forms an electrical connection with both the first resilient member and the second resilient member and the heating and cooling cycle comprises a UL486C heat cycle.

13. The method of claim 10 connecting at least two wires into a waterproof electrical connection to forming a waterproof electrical connection by:

axially forcing an end of a bared wire past an edge of the first resilient member and an edge of the second resilient member while the edge of the first resilient member and the edge of the second resilient member encapsulated in the wire displaceable sealant to simultaneously form a waterproof heat cycleable electrical connection and the end of the bared wire forms electrical contact through engagement with an electrical conducting bus strip.

14. The method of claim 13 wherein sufficient pressure is exerted on the bared wire by the edge of the first resilient member and the edge of the second resilient member so that the electrical connection formed with the bared wire meets or exceeds the UL486C heat cycle test.

15. The method of claim 10 including the step of forcing the wire through an opening in the first resilient member and into a second resilient member located in line with the first resilient member.

16. A push-in wire connector comprising:

a housing having a chamber therein;

a bus strip, said bus strip located within said chamber and held in position by said housing;

a first resilient conductor positioned proximate the bus strip, said first resilient conductor having a wire engaging edge for generating a first wire engaging force toward the bus strip and a second resilient conductor positioned proximate the bus strip, said second resilient conductor having a wire engaging edge for generating a second wire engaging force toward the bus strip, wherein the first wire engaging force is different from said second wire engaging force to enable formation of a heat cycleable electrical connection with a range of different sizes and types of wires.

17. The push-in wire connector of claim 16 including a sealant encompassing the first resilient conductor and the second resilient conductor and the first resilient conductor positioned in front of the second resilient conductor with the first resilient conductor wire engaging force greater than the wire engaging force of the second resilient conductor.

18. The push-in wire connector of claim 17 wherein the first resilient conductor and the second resilient conductor have different spring constants.

19. The push-in wire connector of claim 18 wherein the spring constant of the first resilient conductor is less than the spring constant of the second resilient conductor.

20. The push-in wire connector of claim 18 wherein an axial force to deflect the first resilient conductor is less than an axial force required to deflect the second resilient conductor.

* * * * *